US006809620B2

(12) United States Patent
Höglund

(10) Patent No.: US 6,809,620 B2
(45) Date of Patent: Oct. 26, 2004

(54) TRANSFORMER CORE

(76) Inventor: Lennart Höglund, Blästadsgatan 126, Linköping (SE), SE-589 23

( * ) Notice: Subject to any disclaimer, the term of this patent is extended or adjusted under 35 U.S.C. 154(b) by 68 days.

(21) Appl. No.: 10/203,027

(22) PCT Filed: Feb. 6, 2001

(86) PCT No.: PCT/SE01/00224

§ 371 (c)(1),
(2), (4) Date: Nov. 18, 2002

(87) PCT Pub. No.: WO01/57890

PCT Pub. Date: Aug. 9, 2001

(65) Prior Publication Data

US 2003/0090355 A1 May 15, 2003

(30) Foreign Application Priority Data

Feb. 6, 2000 (SE) ..... 0000410

(51) Int. Cl.[7] ..... H01F 30/12
(52) U.S. Cl. ..... 336/5; 336/213; 336/234
(58) Field of Search ..... 336/5, 212, 213, 336/234, 83, 200, 214, 215, 223, 232, 60; 29/605, 606

(56) References Cited

U.S. PATENT DOCUMENTS 644,565 A * 3/1900 Arnold ..... 336/215
2,486,220 A * 10/1949 Somerville ..... 336/217
2,498,747 A * 2/1950 Wiegand ..... 336/212
2,614,158 A * 10/1952 Zimsky et al. ..... 336/217
2,702,887 A * 2/1955 Joublanc ..... 336/5
3,008,106 A * 11/1961 Richardson, Jr. ..... 336/5
3,195,090 A * 7/1965 Burkhardt et al. ..... 336/218
4,557,039 A * 12/1985 Manderson ..... 29/605
4,639,705 A * 1/1987 Beisser ..... 336/5
4,906,960 A * 3/1990 Alexandrov ..... 336/60
4,907,339 A * 3/1990 Alexandrov ..... 29/605
4,962,362 A * 10/1990 Whittaker ..... 336/175
5,455,553 A * 10/1995 Allan et al. ..... 336/170
6,465,184 B1 * 10/2002 Boel et al. ..... 435/6

* cited by examiner

*Primary Examiner*—Anh Mai
(74) *Attorney, Agent, or Firm*—Sughrue Mion, PLLC

(57) ABSTRACT

A transformer or inductor core of magnetic material has three legs (6, 8, 10) interconnected by yokes. The core comprises loops (12, 14, 16) of wires and/or strips of magnetic material, wherein each of the loops makes up part of two of the legs. Loops making up part of two different leg portions are interleaved in a common leg portion. This provides for mechanical stability and good magnetic properties for the core.

20 Claims, 6 Drawing Sheets

TRANSFORMER CORE

FIELD OF INVENTION

The present invention relates generally to cores made of magnetic material and more particularly to transformer or inductor cores comprising legs and yokes interconnecting the legs. The invention also relates to transformers or inductors comprising such cores and a method of manufacturing such cores.

BACKGROUND

Transformer cores are constructed from ferromagnetic materials, such as iron. This material can be provided in the form of so-called transformer plate, which easily can be cut to strips or wires of constant width. These strips or wires can subsequently be put together to cores having one or more legs and interconnecting yokes.

The Swedish patent publication SE 163 797 (Wiegand) discloses a method of making transformer cores wherein three loops of magnetic material are put together to form a cage core with delta shaped yokes. However, the resulting core suffers from some disadvantages. Firstly, the mechanical stability of the core is poor, as the different loops tend to slide relatively each other. Secondly, the circular leg areas are not filled in an efficient way.

At the present time, there are wires that have better mechanical and magnetic properties than rolled or milled strips. An example thereof is disclosed in the International patent publication WO 99/28919 (Asea Brown Boweri), wherein a magnetic core assembly is made up of wires of magnetic material. However, the transition of magnetic flux between the loops via the legs is hampered by the air-gaps between the individual wires in the loops. These air-gaps can be filled with magnetic composite, for example, but the efficiency is limited.

SUMMARY OF THE INVENTION

An object of the present invention is to provide a core of magnetic material wherein the problems of prior art are eliminated or at least mitigated.

The invention is based on the realization that a transformer or inductor core can be made of loops or rings of strips or wires wherein the strips or wires from different rings are interleaved in the core legs.

With the core according to the present invention the above mentioned drawbacks of prior art are eliminated or at least mitigated. The magnetic flux path of the inventive core has been improved over prior art and the interleaving of the magnetic material also provides mechanical stability to the core.

BRIEF DESCRIPTION OF DRAWINGS

The invention is now described, by way of example, with reference to the accompanying drawings, in which.

DETAILED DESCRIPTION OF THE INVENTION

In the following, a detailed description of preferred embodiments of a core according to the invention will be given. In the description, for purposes of explanation and not limitation, specific details are set forth, such as particular hardware, applications, techniques etc. in order to provide a thorough understanding of the present invention. However, it will be apparent to one skilled in the art that the present invention may be utilized in other embodiments that depart from these specific details. In other instances, detailed descriptions of well-known methods, apparatuses, and circuits are omitted so as not to obscure the description of the present invention with unnecessary details. Also, although a specific number of strip or wire turns are shown in the figure, it will be appreciated that the numbers shown are to give a clear description of the invention and that the actual number of turns and the dimensions will vary with the application, the wire or strip thickness etc.

Figure 1:
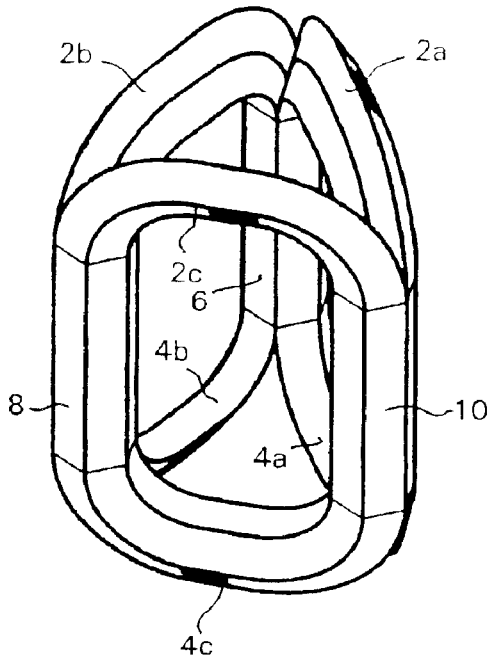
FIG. 1 shows the general shape of a three-phase cage core.

In FIG. 1 there is shown a perspective view of the overall shape of an embodiment of a core according to the invention. The core comprises two generally delta shaped or triangular yokes, an upper yoke comprising portions 2*a–c* and a lower yoke comprising portions 4*a c*, and three legs 6, 8, 10 interconnecting the corners of the yoke triangles. In the following cores of this general shape will be referred to as "cage cores".

The special cage core in this description has three legs that are wound at the same time of wires or strips of magnetic material, such as iron. Each leg has a circular or essentially circular cross-section, as can be seen from FIGS. 2 and 6, for example.

A first embodiment of a cage core according to the invention will now be described with reference to FIGS. 2, 2*a*, 2*b*, and 3. The core 1 is made of frames in the form of almost rectangular "funnels" wound from strips of transformer plate, for example. By using the term "funnel" the cross-section of the frames is accentuated. All strips have constant width, thus reducing costs and waste for the material and also facilitating the manufacturing of the core.

Figure 2B:
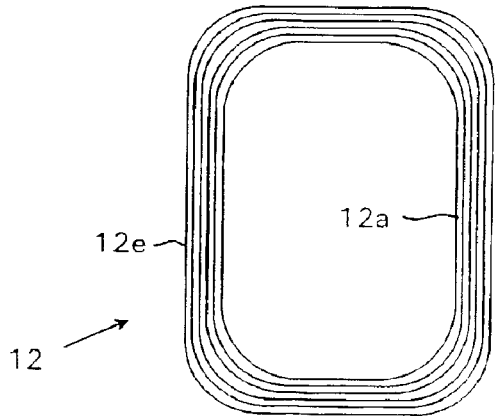
FIG. 2*b* is a side view of the funnel frame shown in FIG. 2*a;*
Figure 2:
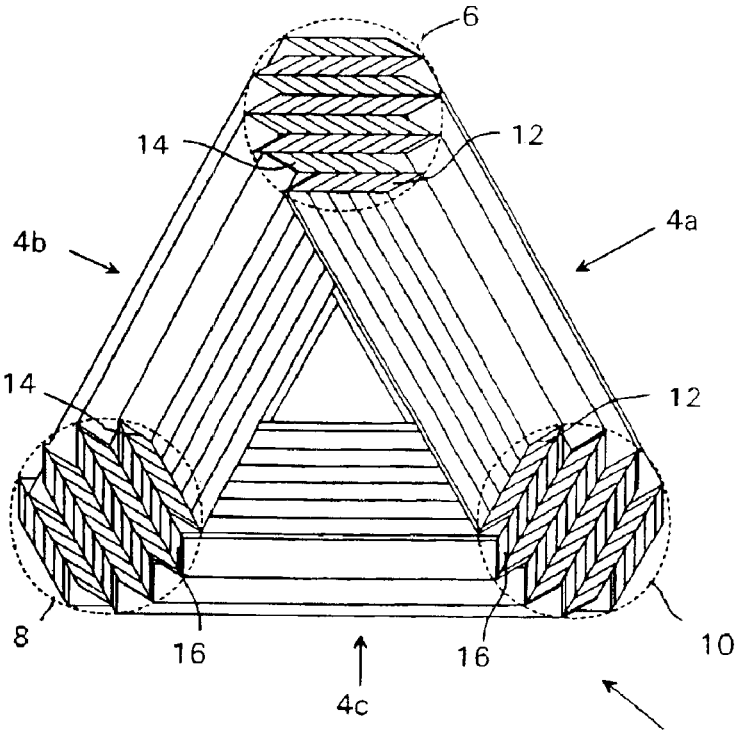
FIG. 2 is a cross-sectional view of the core shown in FIG. 1 made from strips of magnetic material.
Figure 2A:
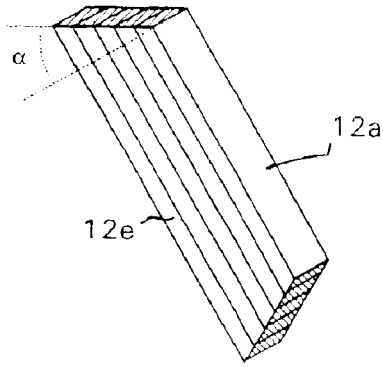
FIG. 2*a* is a detailed view of a funnel frame of magnetic material comprised in the core shown in FIG. 2.

An example of a funnel frame 12 taken from the core in FIG. 2, marked therein by its cross-sections in legs 6 and 10, is shown in FIG. 2*a*. It is appreciated that the funnel frame comprises a number of turns of strips 12*a–e*, in the present example five turns. Each turn is slightly offset from the neighboring turns so as to create an essentially rhomboidal cross-section. When using strips of essentially rectangular cross-sections, the long sides of the turns become slightly jagged, but the small thickness of the strips results in a negligible jaggedness and that fact does not degrade the overall performance of the core. The two cross-sections of a funnel frame are mutually converging rhomboids, see FIG. 2*a*, thereby creating a "funnel". The angle $\alpha$ indicating the slope of the rhomboids is 30 degrees, i.e., the two rhomboids have a mutual angle of 60 degrees.

A side view of the frame 12 is shown in FIG. 2*b*. The frame is made up of one strip wound to the desired number of turns. It can here be seen that each turn 12*a–e* has a smooth, generally rectangular shape with rounded corners. The rounded corners helps providing a satisfactory path for the magnetic field.

Referring again to FIG. 2 it is seen that a second funnel frame 14 having a slightly larger diameter than funnel frame 12 is wound between legs 6 and 8. In all other aspects, funnel frame 14 is identical to funnel frame 12. A third funnel frame 16 is wound between legs 8 and 10 and outside of funnel frames 12 and 14. The third funnel frame has the same general shape as the two first ones. However, to take into account the increasing width needed to fill up a circle, the third funnel frame comprises more turns than funnel frame 12 and 14. Thus, the three funnel frames 12, 14, 16 are mutually rotated 120 degrees, thereby forming a triangle.

Subsequent funnel frames are wound outside of the first three ones in the same order, i.e., counter-clockwise when viewed in the figures. The widths of the subsequent funnel frames are adapted to make the resulting legs nearly circular in cross-section, as indicated by the dashed circles around each leg 6, 8, and 10. In that way strips from one of the loops comprised of funnel frames positioned between two legs are interleaved with strips from another of the loops comprised of funnel frames positioned between two legs, wherein one leg is common to the two loops.

In order to avoid short-circuit within the core, each funnel frame is isolated from adjacent funnel frames by means of strips of isolation. The final shape of the cage core made of strips also appears from FIG. 3, which is a side view of the lower half of the core. The upper half (not shown) is a mirror image of the lower half.

Figure 3:
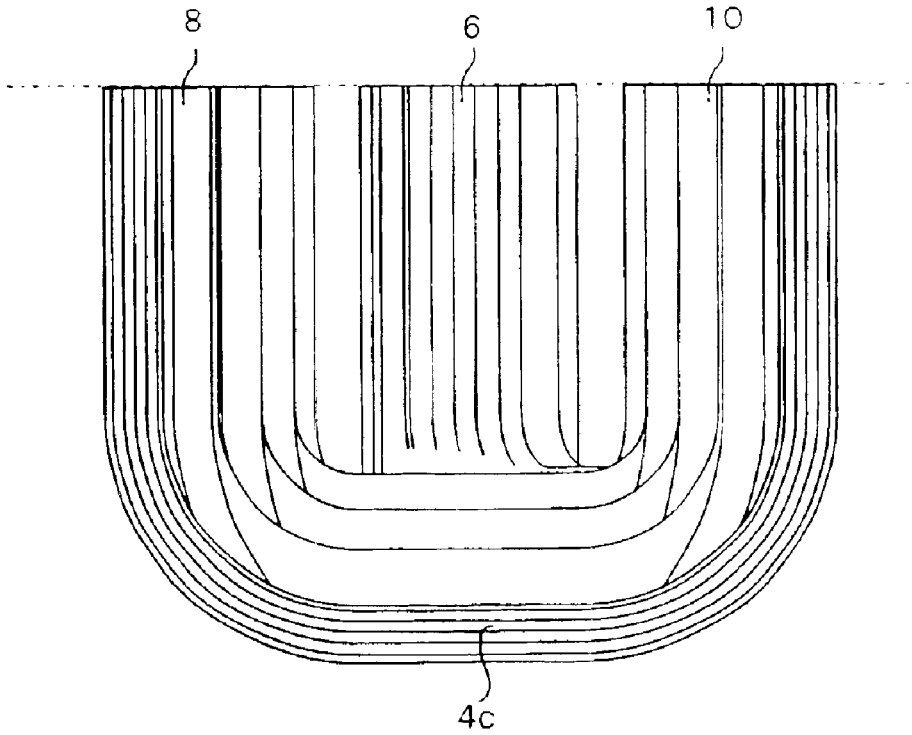
FIG. 3 is a side view of part of the core shown in FIG. 2.

When making a transformer or inductor based on the cage core 1 shown in FIGS. 2 and 3, windings are wound around the legs 6, 8, and 10. This results in a three-phase device with improved electrical and mechanical properties as compared with prior art cage cores.

Figure 4:
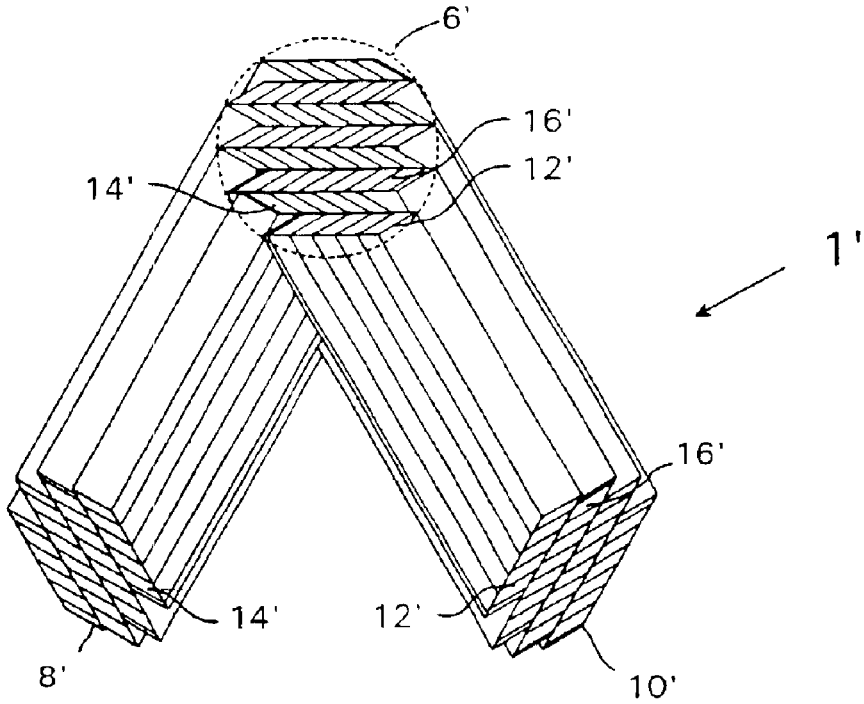
FIG. 4 is a cross-sectional view of a single-phase transformer core derived from the three-phase core shown in FIGS. 2 and 3.

A derivative of the three-phase cage core shown in FIGS. 2 and 3 is the single-phase core 1' shown in FIG. 4. This core is essentially identical to the three-phase core but with the funnel frames interconnecting legs 8 and 10 omitted. This single-phase core 1' comprises a first inner funnel frame 12' and a second funnel frame 14' wound outside of funnel frame 12' with a mutual angle of 60 degrees. This is identical to what is shown in FIG. 2. However, instead of having a third funnel frame interconnecting legs 8' and 10', the third funnel frame 16' is wound outside of and parallel to funnel frame 12' between legs 6' and 10'. Subsequent funnel frames are wound alternately between legs 6', 8' and 6', 10' until an essentially circular leg 6' has been built up. When completing a transformer or inductor based on this single-phase core 1', windings are wound around leg 6'. That legs 8' and 10' have irregular cross-sectional shapes are thus of no relevance.

Figure 5:
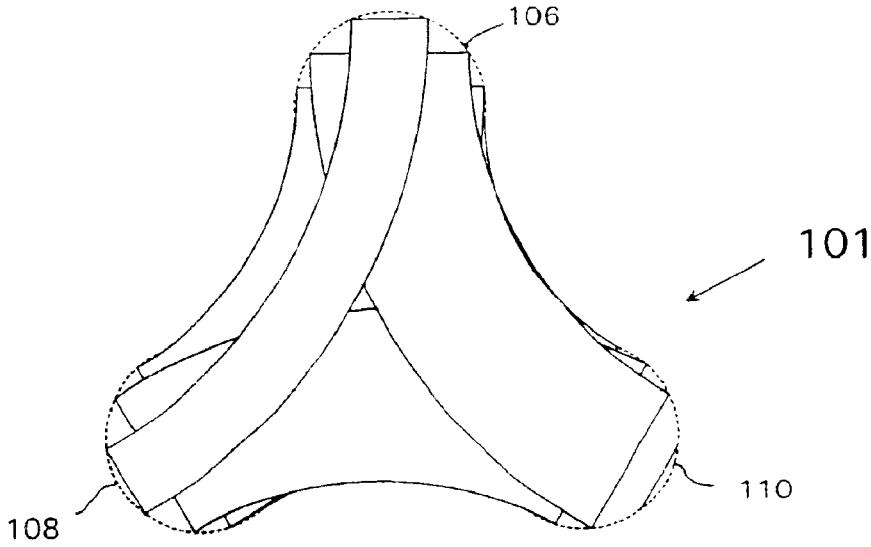
FIG. 5 is a plan view of a core made from wires of magnetic material.
Figure 6:
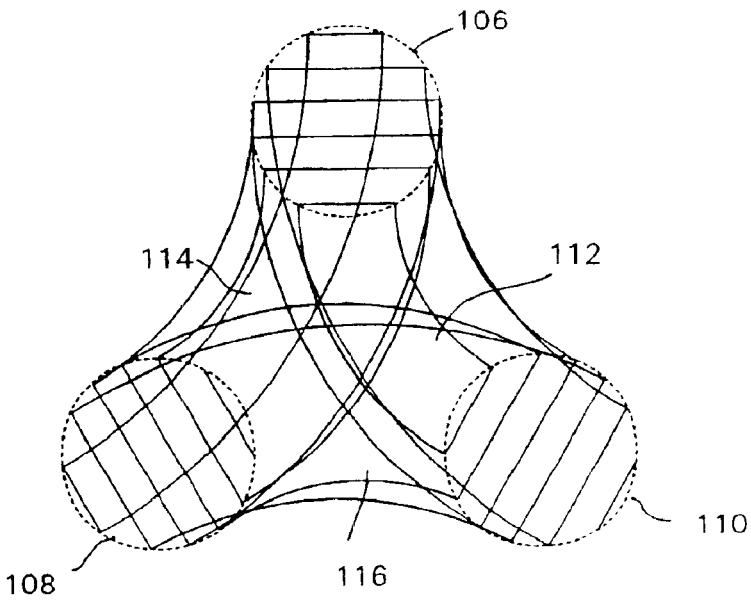
FIG. 6 is a cross-sectional view of the core shown in FIG. 5.
Figure 6A:
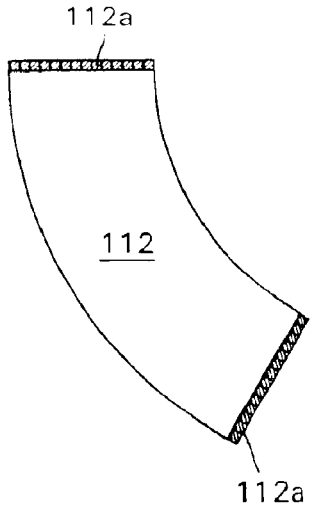
FIG. 6*a* is a detailed view of a frame of magnetic material comprised in the core of FIG. 6.

A second embodiment of a three-phase cage core according to the invention will now be described with reference to FIGS. 5, 6, and 6*a*. In FIG. 5, showing a plan view of a cage core 101, there is apparent how a number of layers of wires are wound between three legs 106, 108, 110, thereby forming "funnels" similar to those of the first embodiment. The wires have square cross-sectional shape, see FIG. 6*a*, and to get smooth layers in the legs and not saw tooth surfaces, the wires in the yokes are bent towards the centerline of the core. In FIG. 6 a first inner funnel frame 112 is shown positioned between legs 106 and 108. This funnel frame is also shown in detail in FIG. 6*a*, wherein the perfect alignment of the wires constituting the funnel frame is apparent. In FIG. 6*a* there are also shown the individual wires 112*a* having square cross-section.

A second layer of wires 114 is wound outside of funnel frame 112 and between legs 106 and 108. A third layer 116 is wound outside of the second funnel frame 114 in leg 108 and outside of the first funnel frame 112 in leg 110. Subsequent layers or funnel frames are wound outside of the first three funnel frames 112, 114, 116 and with varying widths so as to create essentially circular legs. Each interleaved layer of wires is isolated from the adjacent layers so as to avoid short circuit within the core.

As a rule, in a real core, the thickness of the wires is negligible compared with the thickness of the legs. For purpose of illustration, the layers of the core shown in FIGS. 5 and 6 have been depicted as having air there between, which causes adjacent layers to vary greatly in width. In practice, there would be many more layers of wires in the legs than shown in the figures.

Figure 7:
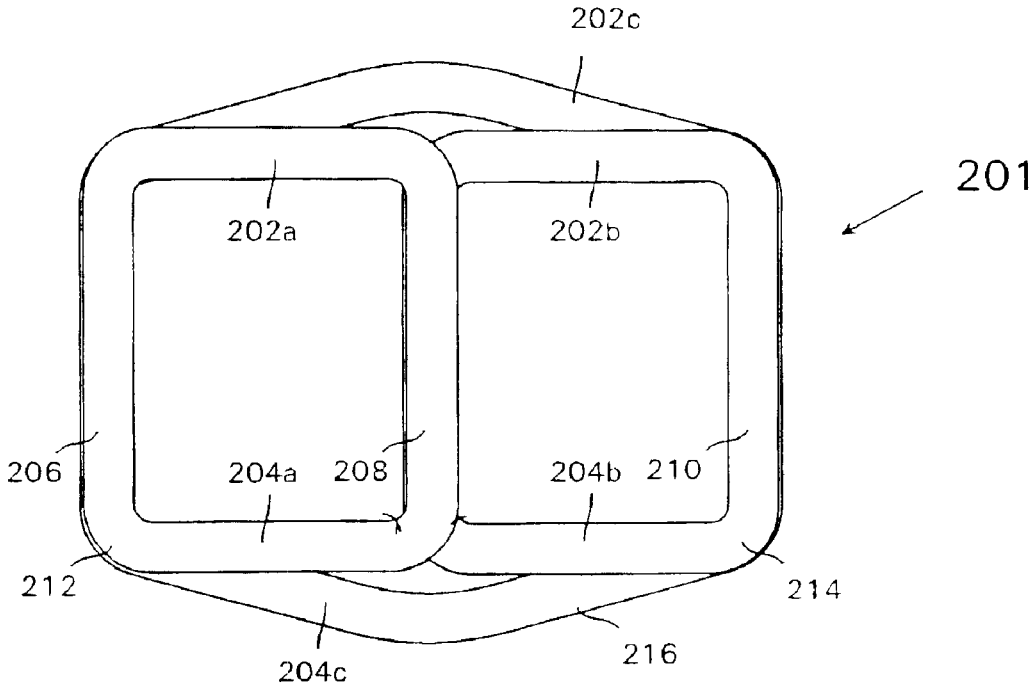
FIG. 7 is a side view of a three-phase transformer with aligned legs.
Figure 8:
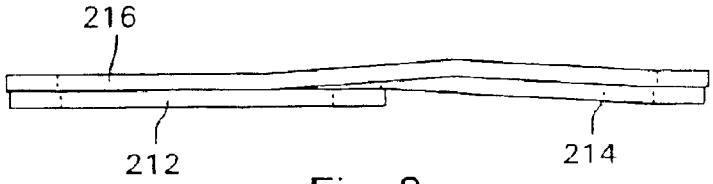
FIG. 8 is a plan view of one layer of the core shown in FIG. 7.
Figure 9:
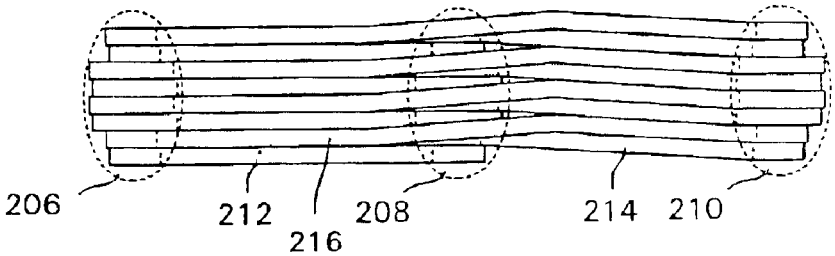
FIG. 9 is a plan view of several interleaved layers of the core shown in FIG. 7.

A third embodiment of a three-phase transformer core will now be described with reference to FIGS. 7–9, wherein the same inventive concept of interleaved layers of strips or wires is used. However, the core 201 shown in FIGS. 7–9 is not a cage core but a core with three aligned legs, i.e., the three legs are positioned on a common straight line in a row. This configuration is advantageously used in a train waggon, for example, where a rectangular space is available for the core.

The core comprises three legs 206, 208, 210, the end portions of which are interconnected by an upper yoke comprised of portions 202*a–c* and a lower yoke comprised of portions 204*a–c*. The entire structure is made up of a number of rings of wires or strips of magnetic material. Each ring has two opposing essentially straight sides making up part of two legs and two opposing sides interconnecting the leg sides and thus making up part of the yokes.

The basic configuration will now be described with reference to FIGS. 7 and 8. A first ring 212 is positioned so as to make up part of the left leg 206 and the center leg 208. A second ring 214 is then put so as to overlap the first ring 212 in the area of the center leg 208. The first and the second essentially planar rings 212, 214 are identical or almost identical to their shape, each having four straight sides interconnected by rounded smooth corners, giving a good path for the magnetic flux circulating in the core.

Finally there is a third larger ring 216 positioned overlapping the first and second rings in the area of the left leg 206 and the right leg 210. The yoke sides of this larger ring 216 is curved and bent so as not to interfere with the first and second rings.

The basic configuration shown in FIG. 8 comprising three rings creates three legs and interconnecting yokes. In order to complete the core, further rings are added, see FIG. 9. Although not necessary, the heights of the rings are adapted so as to create legs with close to elliptical cross-sectional shapes. Thus, each leg is comprised of interleaved rings alternately leading to one of the two other legs.

Figure 9A:
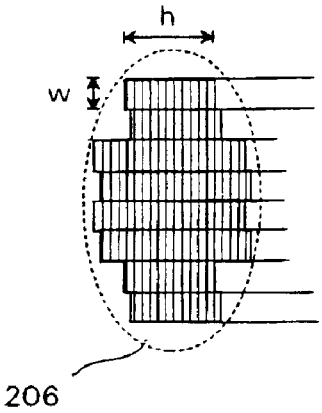
FIG. 9*a* is a detailed cross-sectional view of a leg of the core shown in FIG. 9.

Each of the rings 212, 214, 216 is made up of a number of turns of strips of magnetic material with constant width, see FIG. 9*a*. Thus, the number of turns and the thickness of the strips will determine the height h of each ring while the width of the strips will determine the width w of the ring.

In this embodiment the magnetic flux will go from one yoke to another via the sides of the rings of strips. An alternative to using strips is to use wires. In the case wires are used the width of the rings shall be made so small that the transition of magnetic flux is easy obtained also from wires inside the ring. In the case of strips the approximation of cylindrical legs can be made by using narrow strips and by the interleaving of the rings yet get good transition of flux.

Figure 10:
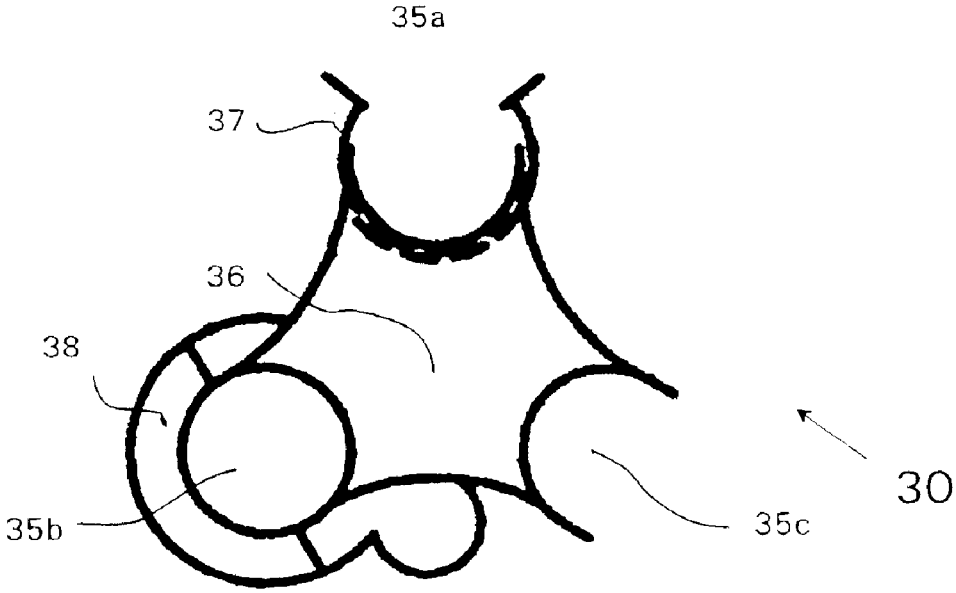
FIGS. 10 and 11 show a side view and a top view, respectively, of a frame used for manufacturing the inventive cage core.
Figure 11:
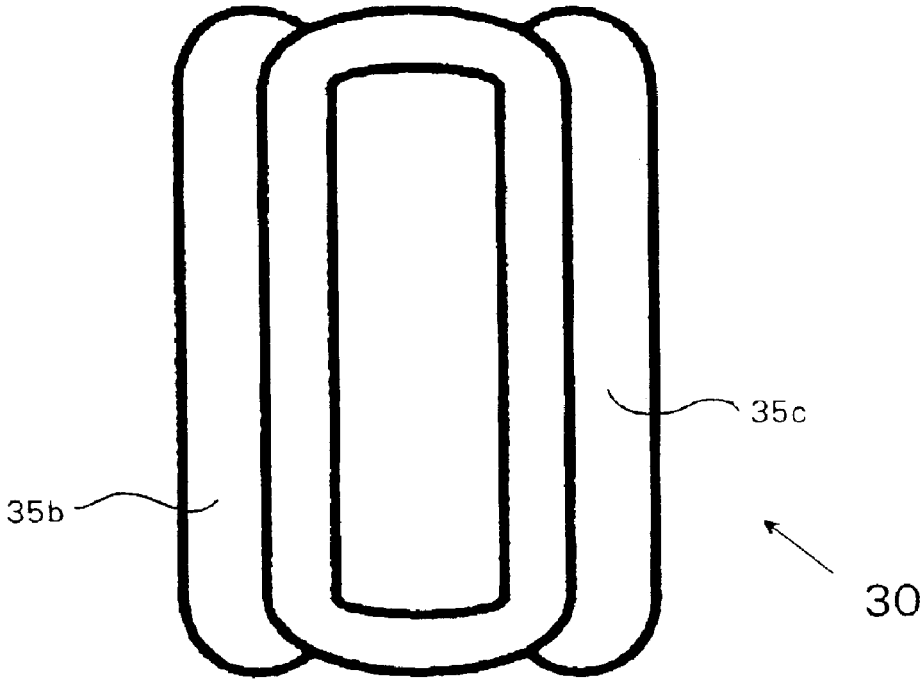

A spool stand used when manufacturing a cage core according to the invention will now be described with reference to FIGS. 10 and 11. In FIG. 10 there is shown a spool stand 30 for iron wires from the yoke side while in FIG. 11 the same spool stand is shown from the side, wherein two grooves for legs are seen in the foreground. The spool stand is made of three parallel grooves 35*a–c* with openings outwards in respective directions shifted 120 degrees and convex portions 36 between the ends of the grooves.

When manufacturing the core, rings or frames of iron wires are wound between two of the grooves 35*a–c* in a circular pattern, e.g., first between grooves 35*c* and 35*a*, then between grooves 35*a* and 35*b*, then between grooves 35*b* and 35*c*, then again between grooves 35*c* and 35*a* and so on, until circular or essentially circular legs have been built up. To assist shaping the legs, ribbons or laths (not shown) can be used. Supporting pipe halves 37 or divisible bearings 38 can also be used, see FIG. 10. Alternatively, all or part of the core can be built from funnel-shaped, thin coils of wire that are manufactured separately by winding wire on stands with conical cross-section.

Figure 12:
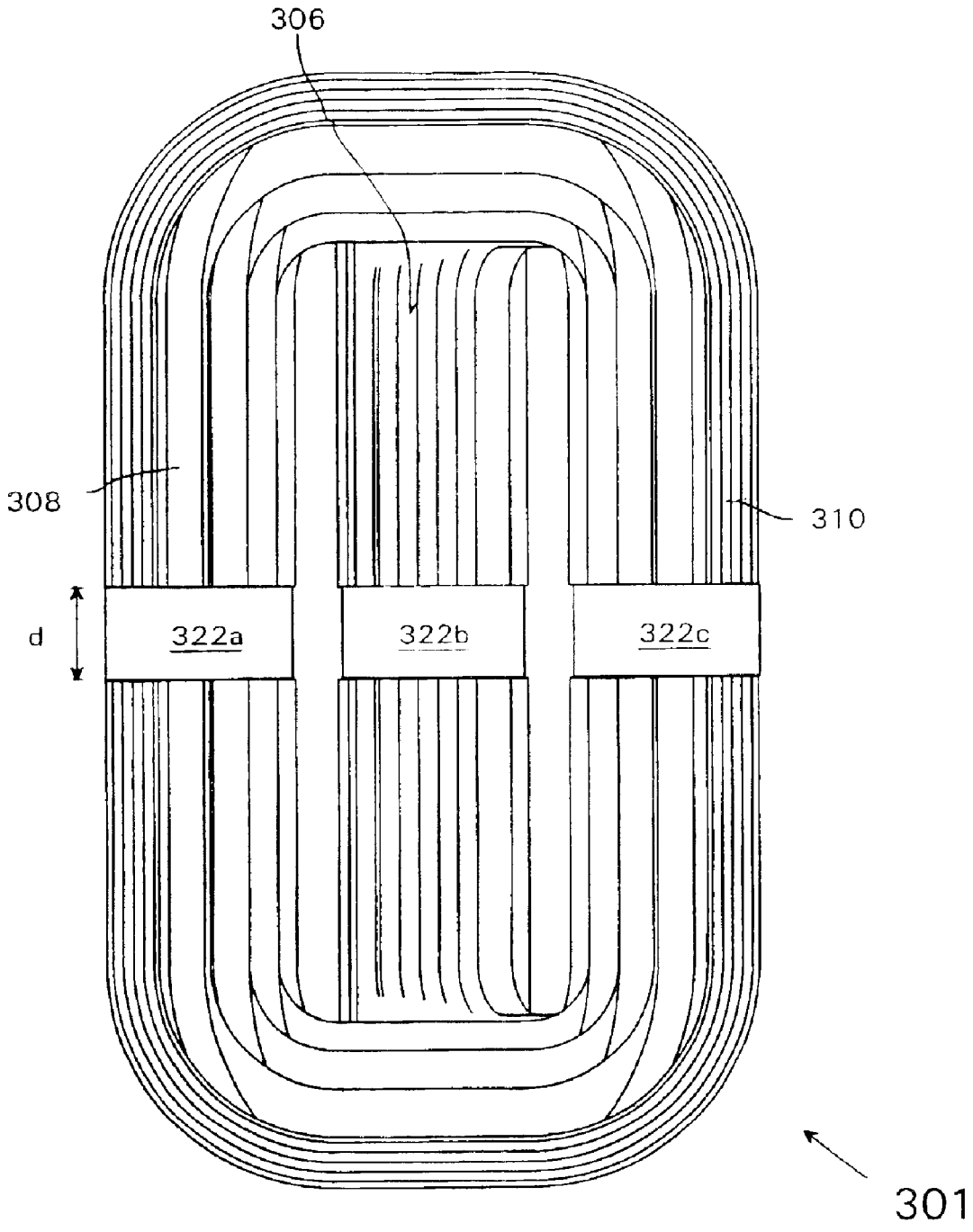
FIG. 12 is a side view of an inductor core.

In FIG. 12 there is shown a side view of a cage core used as an inductor core. This core 301 is similar to the core described with reference to FIGS. 2 and 3, having three legs 306, 308, 310 interconnected by an upper and a lower yoke. However, after manufacturing, each of the legs has been severed in at least one place, resulting in two core halves, an upper and a lower half, separated by a gap of the distance "d". These gaps are filled with some suitable non-conductive material. This results in a core having a much larger magnetic resistance than the transformer core, giving it suitable properties for use as an inductor core. Also, the inherent mechanical stability of the core according to the invention makes this division of the core into two halves possible.

Preferred embodiments of a core according to the invention have been described. The person skilled in the art realizes that these could be varied within the scope of the appended claims. Thus, in all the above-described embodiments, imperfections in the shape of the core could be corrected by filling with a magnetic composite material, for example. The filling might be necessary to maximize the effect of a transformer when the core is made of round wires in three separately wound rings. The overlapping wire layers allow the flux to pass between the yokes via the leg sections and thus improve the properties of the transformer.

The funnel frames making up the inventive core have been shown with essentially rectangular shape with rounded corners. It will be realized that, due to the flexible nature of the strip or the wire, the shape can deviate from what is shown in the drawings. Thus, the leg and/or yoke portions can be slightly curved or arched.

Also, it has been stated that the cross-sections of the legs are circular or near circular. They can also deviate from the circular shape and be elliptical etc.

In the wire core embodiment described with reference to FIGS. 5 and 6, the yokes are bent towards the center-line of the core. However, when using wires the yokes can also have the shape shown in FIG. 2, i.e., being straight between the legs. This is preferably used with wires of a cross-sectional shape different than square, such as circular, rhomboidal, or rhombic.

Also, the wires shown in FIG. 6*a* have a square cross-sectional area. It will be appreciated that these wires also can have a rectangular cross-sectional area without altering the general core shape shown in FIGS. 5 and 6.

The wires used with the wire core have been described as iron wires. The wires can of course be of any suitable magnetic material having the desired properties. They can also be of an amorphous material.

Although only the cage core configuration has been shown as an inductor core, see FIG. 12, it is realized that the core with the legs in a row, see FIGS. 7–9, is equally suitable for use as an inductor core.

All cores described herein have a number of frames or rings of strips and/or wires. In the cage core embodiments described with reference to FIGS. 1–6 the core is described as comprising a number of separate frames or rings of magnetic material. It will be appreciated that a single strip or wire can be used in several or even all frames, i.e., when one frame has been wound another is wound from the same strip or wire without cutting the first one or using a new one. This would allow for a continuous manufacturing process, possibly interrupted by a short period wherein the core is rotated 120 degrees to allow for winding of another of the three sides of the core.

What is claimed is:

1. A core of magnetic material having a first, a second, and a third leg portion and a first and a second yoke portion, said core comprising:

loops of wires and/or strips of magnetic material;

each of said loops making up part of two of said leg portions;

wherein loops making up part of two different leg portions are interleaved in a common leg portion of said leg portions, wherein each of said loops comprises a plurality of layers of wires and/or strips of magnetic material, and wherein each of said layers comprises a plurality of wires and/or strips.

2. The core according to claim 1, wherein said leg portions are provided in a triangular pattern.

3. The core according to claim 1, wherein said leg portions are provided in a row.

4. The core according to claim 1, wherein said magnetic material is an amorphous material.

5. The core according to claim 1, wherein said leg portions have an essentially circular cross-sectional area.

6. The core according to claim 1, wherein said leg portions have an essentially elliptic cross-sectional area.

7. The core according to claim 1, wherein said leg portions comprise a magnetic composite material.

8. The core according to claim 1, wherein a single wire or strip is used in several loops.

9. A three-phase transformer having a core of magnetic material with a first, a second, and a third leg interconnected by a first and a second yoke, and primary and secondary windings wound around said legs, characterized in that said core is a core according to claim 1.

10. The core according to claim 1, wherein each of said layers comprises a plurality of strips, each of said strips being offset from adjacent strips.

11. The core according to claim 10, wherein the strips are of constant width.

12. The core according to claim 1, wherein each of said layers comprises a plurality of wires.

13. The core according to claim 12, wherein the wires have a square cross-sectional area.

14. The core according to claim 1, wherein all of said loops have one common leg portion.

15. A single-phase transformer having a core of magnetic material with a first, a second, and a third leg interconnected by a first and a second yoke, and primary and secondary windings wound around one of said legs, wherein said core is a core according to claim 14.

16. The core according to claim 1, wherein each of said legs comprises a portion of non-conductive material.

17. A three-phase inductor having a core of magnetic material with a first, a second, and a third leg interconnected by a first and a second yoke, and windings wound around said legs, characterized in that said core is a core according to claim 16.

18. A method of manufacturing a core of magnetic material having a first, a second, and a third leg portion and a first and a second yoke portion, said method comprising the following steps:

a) winding a first loop of wires and/or strips of magnetic material, said first loop making up part of said first and second leg portions;

b) winding a second loop of wires and/or strips of magnetic material, said second loop making up part of said second and third leg portions;

c) winding a third loop of wires and/or strips of magnetic material, said third loop making up part of said third and first leg portions;

d) repeating steps a)–c) until final cross-sectional shapes of said leg portions are obtained, wherein loops making up part of two different leg portions are interleaved in a common leg portion of said leg portions, wherein each of said loops comprises a plurality of layers of wires and/or strips of magnetic material, and wherein each of said layers comprises a plurality of wires and/or strips.

19. The method according to claim 18, wherein said loops are wound separately.

20. The method according to claim 19, wherein the loops are wound on stands with conical cross section.

* * * * *